US010270147B2

(12) United States Patent
Yatabe

(10) Patent No.: US 10,270,147 B2
(45) Date of Patent: Apr. 23, 2019

(54) DIELECTRIC WAVEGUIDE, MOUNTING STRUCTURE FOR A DIELECTRIC WAVEGUIDE, DIELECTRIC WAVEGUIDE FILTER AND MASSIVE MIMO SYSTEM

(71) Applicant: Murata Manufacturing Co., Ltd., Kyoto-fu (JP)

(72) Inventor: Yukikazu Yatabe, Saitama (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 428 days.

(21) Appl. No.: 15/063,716

(22) Filed: Mar. 8, 2016

(65) Prior Publication Data

US 2016/0268662 A1 Sep. 15, 2016

(30) Foreign Application Priority Data

Mar. 13, 2015 (JP) ..... 2015-050462
Oct. 29, 2015 (JP) ..... 2015-213250

(51) Int. Cl.

| | |
|---|---|
| ***H01P 1/20*** | (2006.01) |
| ***H01Q 21/00*** | (2006.01) |
| ***H01P 7/10*** | (2006.01) |
| ***H01P 1/208*** | (2006.01) |
| ***H01P 5/08*** | (2006.01) |
| ***H01Q 21/06*** | (2006.01) |

(52) U.S. Cl.

CPC ..... *H01P 1/2002* (2013.01); *H01P 1/2084* (2013.01); *H01P 5/087* (2013.01); *H01P 7/10* (2013.01); *H01Q 21/0006* (2013.01); *H01Q 21/065* (2013.01)

(58) Field of Classification Search

CPC .... H01P 1/2084; H01P 1/2086; H01P 1/2002; H01P 7/10; H01P 7/105
USPC ..... 333/208, 209, 248, 239, 206
See application file for complete search history.

(56) References Cited

U.S. PATENT DOCUMENTS 6,373,352 B1 * 4/2002 Lee ..... H01P 1/2136 333/134
2003/0016100 A1 1/2003 Kojima et al.
(Continued)

FOREIGN PATENT DOCUMENTS

JP 2000-286606 10/2000
JP 2002-043807 A 2/2002
(Continued)

OTHER PUBLICATIONS

Japanese Office Action for corresponding Japanese Patent Application No. 2015-213250 dated Jan. 9, 2018, with English translation.

*Primary Examiner* — Stephen E. Jones
(74) *Attorney, Agent, or Firm* — Renner Otto Boisselle & Sklar, LLP

(57) ABSTRACT

A dielectric waveguide includes a dielectric of a rectangular parallelepiped in shape, an input/output electrode formed on a first face of the dielectric, and a conductor film formed on an outer face of the dielectric. The input/output electrode extends from a first end which is a vertex or a neighborhood of the vertex of a first face (bottom face) of the dielectric inward on the bottom face; and environs along both sides and the first end of the input/output electrode include a conductor-unformed section in which there is no conductor film.

18 Claims, 22 Drawing Sheets

(56) References Cited

U.S. PATENT DOCUMENTS

2004/0085151 A1* 5/2004 Fukunaga ..... H01P 3/121
333/26
2006/0261913 A1* 11/2006 Ye ..... H01P 1/2136
333/134

FOREIGN PATENT DOCUMENTS

| | | | |
|---|---|---|---|
| JP | 2002-135003 | A | 5/2002 |
| JP | 2003-110307 | A | 4/2003 |
| JP | 2004-153368 | A | 5/2004 |
| JP | 2004-312217 | A | 11/2004 |
| JP | 2011-244451 | A | 12/2011 |

* cited by examiner

DIELECTRIC WAVEGUIDE, MOUNTING STRUCTURE FOR A DIELECTRIC WAVEGUIDE, DIELECTRIC WAVEGUIDE FILTER AND MASSIVE MIMO SYSTEM

CROSS REFERENCE

This Nonprovisional application claims priority under 35 U.S.C. § 119 (a) on Patent Application No. 2015-050462 filed in Japan on Mar. 13, 2015, and on Patent Application No. 2015-213250 filed in Japan on Oct. 29, 2015, the entire contents of which are hereby incorporated by reference.

BACKGROUND OF THE INVENTION

The present invention relates to a dielectric waveguide, and particularly relates to a structure of an input/output section for a signal to/from the dielectric waveguide, a mounting structure for the dielectric waveguide onto a board, a dielectric waveguide filter and a Massive MIMO system.

As an input/output structure for enabling a dielectric waveguide filter or the like formed by coupling a plurality of dielectric waveguide resonators to be mounted directly onto a printed circuit board, an input/output structure of a dielectric waveguide in which input/output electrodes are formed on bottom faces and side walls of dielectric waveguide resonators that perform inputting/outputting has been used, as disclosed, for example, in Japanese Patent Unexamined Publication No. 2002-135003 and 2003-110307 bulletins.

FIG. 17 is a bottom perspective view showing an example of a dielectric waveguide filter utilizing the input/output structure of the dielectric waveguide described in the Japanese Patent Unexamined Publication No. 2002-135003 and 2003-110307 bulletins.

The dielectric waveguide filter 100 consists of a plurality of dielectric waveguide resonators 102 of which resonance mode is TE mode. The dielectric waveguide resonators 102 are coupled through slits 103. Bottom faces 102*b* of the dielectric waveguide resonators 102 are each provided with belt-shaped input/output electrodes 105 respectively extending from the middle of two sides that are opposite each other toward the directions of the opposite sides. Environs along both side portions and an end portion of each of the input/output electrodes 105 are provided with conductor-unformed sections 106, 107. The rest of the portions are covered with a conductive film.

SUMMARY OF THE INVENTION

An input/output structure of a dielectric waveguide according to the present invention is an input/output structure of a dielectric waveguide, the dielectric waveguide comprising a dielectric of a rectangular parallelepiped in shape, an input/output electrode formed on a first face of the dielectric, and a conductor film formed on an outer face of the dielectric, wherein the input/output electrode extends from a first end which is a vertex or a neighborhood of the vertex of the first face of the dielectric inward on the first face; and environs along both sides and the first end of the input/output electrode include a conductor-unformed section in which there is no conductor film.

DETAILED DESCRIPTION OF THE INVENTION

Figure 1A:
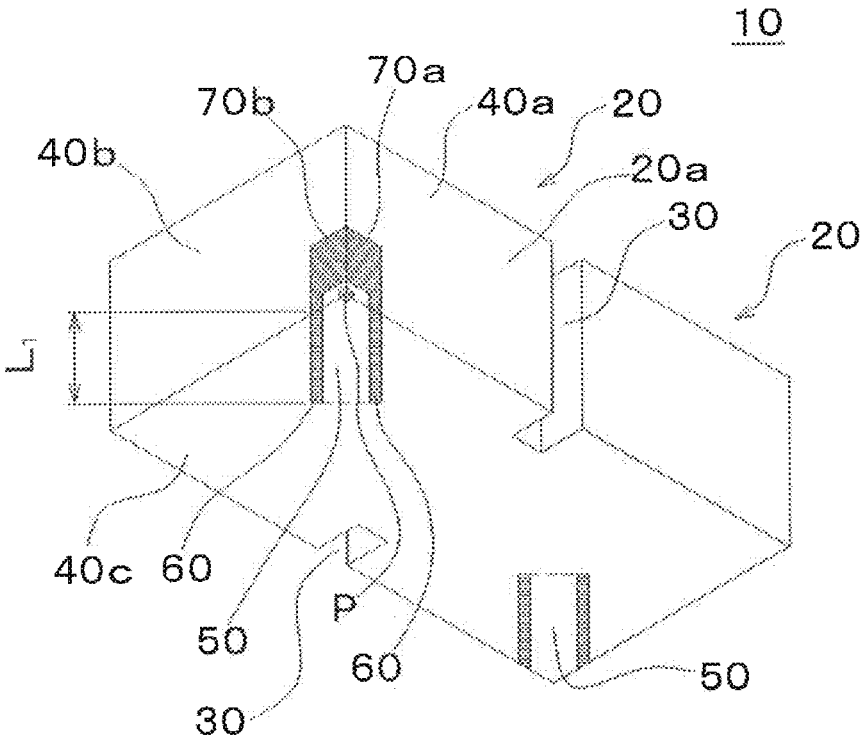
FIG. 1A is a bottom perspective view of a dielectric waveguide filter 10 according to a first embodiment that is provided with an input/output structure of a dielectric waveguide of preferred embodiment of the present invention.

Hereafter, a plurality of embodiments implementing the present invention are shown, referring to the drawings and thereby giving some concrete examples. In the drawings, the same reference signs are assigned to the same parts. Although the embodiments are being shown separately taking account of the purpose of explaining main points or the ease of understanding, partial replacement or combination of constitutions may be possible within different embodiments shown. From the second embodiment onward, description of any matter that is the same as in the first embodiment will be omitted, and explanation will be made only on what is different from the first embodiment. In particular, the same function and effect by the same constitution will not be discussed per embodiment.

First Preferred Embodiment

Figure 1B:
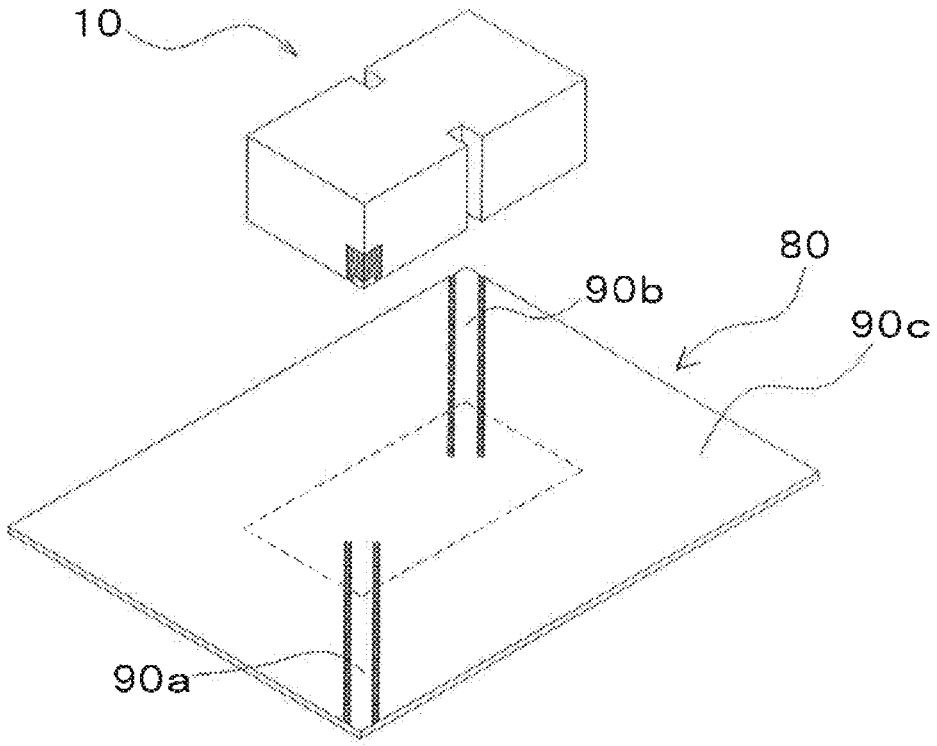
FIG. 1B is an exploded perspective view showing a mounting structure for the dielectric waveguide filter 10 onto a printed circuit board.

FIG. 1A is a bottom perspective view of a dielectric waveguide filter 10 according to a first embodiment that is provided with an input/output structure of a dielectric waveguide of preferred embodiment of the present invention. FIG. 1B is an exploded perspective view showing a mounting structure for the dielectric waveguide filter 10 onto a printed circuit board.

As shown in FIG. 1A, the dielectric waveguide filter 10 includes two dielectric waveguide resonators 20.

The dielectric waveguide resonators 20 include a dielectric of a rectangular parallelepiped in shape in which two domains are formed with a pair of slits 30 provided in between, a pair of input/output electrodes 50 and a conductor film 20*a* that are formed on an outer face of the dielectric. The slits 30 are an example of a "narrowed section" according to the present invention. It can also be said that the two dielectric waveguide resonators 20 are coupled with each other through a section where the slits 30 are formed.

Each of the dielectric waveguide resonators 20 resonates in TE mode. In a representation of a resonance mode by TExyz, each of the dielectric waveguide resonators 20 is a dielectric waveguide resonator that resonates in TE110 mode.

A first face (hereinafter referred to as "bottom face") of the dielectric of the dielectric waveguide filter 10 is an H-plane of the waveguide, and the dielectric waveguide resonators 20 are electromagnetically coupled with each other through an iris (inductive window) that is formed by the slits 30.

The input/output electrode 50 extends in a belt-like shape on the bottom face 40*c* of the dielectric from a first end which is a vertex P of the rectangular parallelepiped in shape toward a direction to a middle part of the bottom face of the dielectric waveguide resonator. A dimension L1 in FIG. 1A is an extension length of the input/output electrode 50. Further, environs along both sides and the first end of the input/output electrode 50 are provided with conductor-unformed sections 60, 70*a*, 70*b* in which there is no conductor film.

Here, "both sides of the input/output electrode 50" means left side and right side thereof when viewed toward the direction to which the input/output electrode 50 extends. Also, the statement that environs along the first end of the input/output electrode 50 is a conductor-unformed section means that starting point in the direction of extension of the input/output electrode 50 is separated from the conductor film.

Moreover, the input/output electrode 50 is not limited to the one that extends from a vertex inward on the bottom face of the dielectric. With a definition of a neighborhood of the vertex as "a first end" according to the present invention, therefrom the input/output electrode 50 may extend inward on the bottom face. Here, the "neighborhood of the vertex" is, for example, a range of distance less than a fourth of the extension length of the input/output electrode 50.

As shown in FIG. 1B, the dielectric waveguide filter 10 is mounted onto a printed circuit board 80. The printed circuit board 80 includes lines 90*a*, 90*b* of which tip portions are each formed in a shape generally the same as the input/output electrode 50, and a ground pattern 90*c*. In the state in which the dielectric waveguide filter 10 is mounted, the input/output electrodes 50, 50 of the dielectric waveguide filter 10 are connected to the tips of the lines 90*a*, 90*b* on the printed circuit board 80, respectively, and the conductor film 20*a* of the dielectric waveguide filter 10 is connected to the ground pattern 90*c* on the printed circuit board 80.

The above-mentioned lines 90*a*, 90*b* together with the ground pattern 90*c* constitute a coplanar waveguide. In a case where a planar ground pattern extending on a bottom face of the printed circuit board 80 is formed, they constitute a grounded coplanar waveguide. Further, in the case where the planar ground pattern extending on the bottom face of the printed circuit board 80 is formed, and when widths of electrode-unformed regions on both side portions of the respective lines 90*a*, 90*b* are wide, the above-mentioned lines 90*a*, 90*b* together with the ground pattern on the bottom face constitute a microstripline.

Generally, in TE mode waveguide resonators, when a resonator is cylindrical in shape, the electric field is strongest at the center of the resonator and weakest at an outer periphery thereof while the magnetic field is distributed uniformly in such a manner as to circumvent the center of the resonator. And when a dielectric waveguide resonator is rectangular parallelepiped in shape, the magnetic field, being unable to be distributed uniformly, becomes strongest at side faces that are nearer to the center of the resonator, and weakest at the center and corner portions of the resonator. That is to say, when a dielectric waveguide resonator is rectangular parallelepiped in shape, both the electric field and the magnetic field become weakest at the corner portions; therefore, leakage of the electromagnetic field remains small even when the input/output electrodes are provided at the corner portions on the bottom face of the dielectric.

Also, in order for the input/output electrodes provided at the corner portions on the bottom face of the dielectric to function, it is necessary for environs along both sides and the first end of the input/output electrodes to be provided with conductor-unformed sections in which there is no conductor film. The reason is that electromagnetic field mismatch increases when there is any conductor film in the environs along both sides and the first end of the input/output electrode 50.

That is to say, by providing the input/output electrodes at the corner portions on the bottom face of the dielectric, and by providing the conductor-unformed sections where there is no conductor film in the environs along both sides and the first end of the input/output electrodes, the electromagnetic field mismatch arising from discontinuity between the lines provided on the printed circuit board and the input/output electrodes of the dielectric waveguide can be reduced. This makes it possible to reduce losses due to the reflection and/or radiation of the electromagnetic field at input/output sections of the dielectric waveguide.

Additionally, because the shape of the input/output electrode substantially changes when misalignment occurs during mounting if the dimensions of the tip of the line on the printed circuit board and the input/output electrode are the same, the widths of the tip portions of the lines 90*a*, 90*b* formed on the printed circuit board may be made smaller than the line widths of the input/output electrodes 50 of the dielectric waveguide filter 10, taking such positional deviation into account. This makes it possible to suppress characteristic changes due to the above-mentioned deviation.

Figure 2:
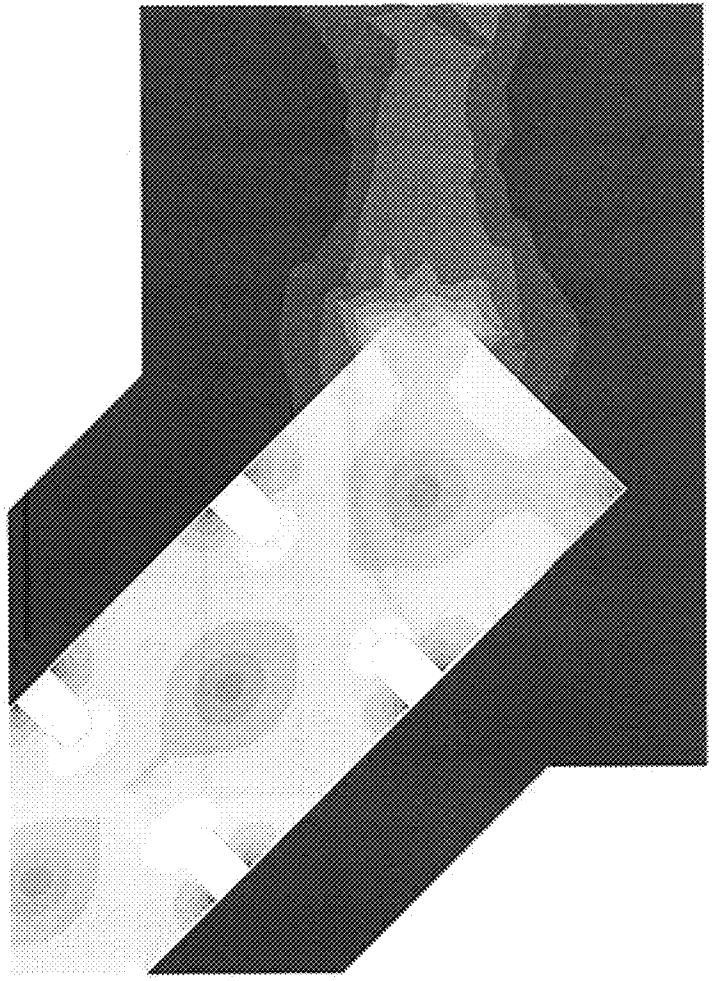
FIG. 2 is a drawing showing a result of a simulation performed on the magnetic field strength distribution of the dielectric waveguide filter that is provided with the input/output structure of the dielectric waveguide according to the first embodiment.
Figure 17:
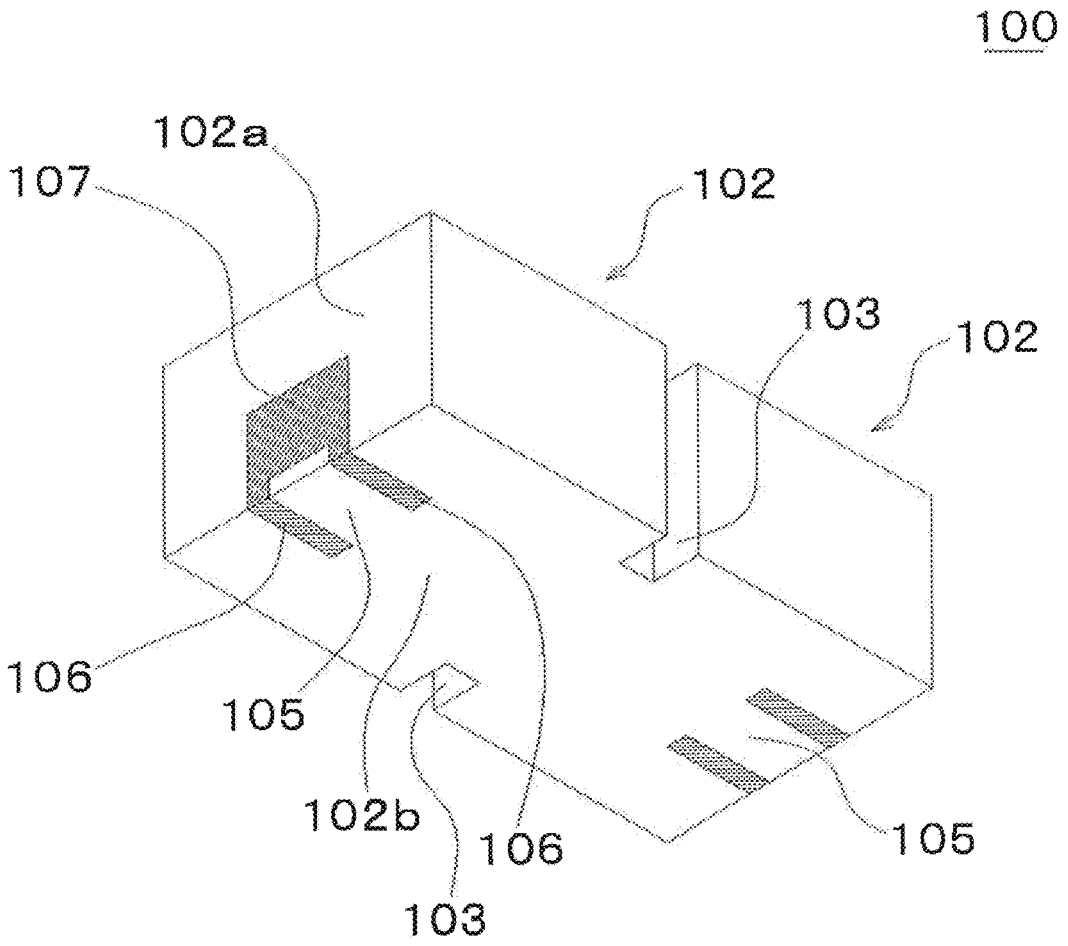
PRIOR ART FIG.17
FIG. 17 is a bottom perspective view showing an example of a dielectric waveguide filter utilizing the input/output structure of the dielectric waveguide described in the Japanese Patent Unexamined Publication No. 2002-135003 and 2003-110307 bulletins.
Figure 18:
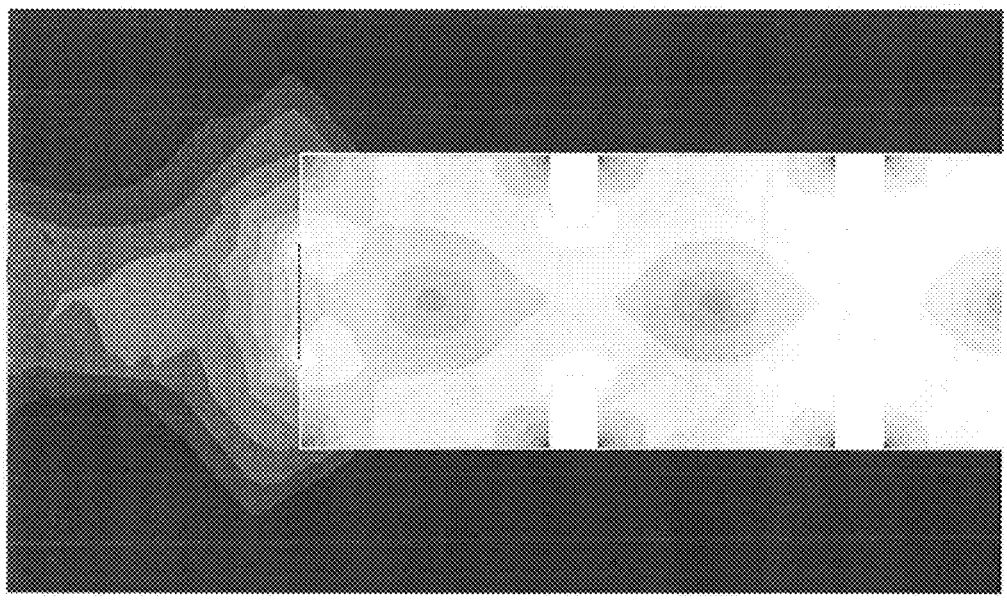
PRIOR ART FIG.18
FIG. 18 is a drawing showing a result of a simulation performed on the magnetic field strength distribution of the dielectric waveguide filter that is provided with the conventional input/output structure of the dielectric waveguide shown in FIG. 17.

FIG. 2 is a drawing showing a result of a simulation performed on the magnetic field strength distribution of the dielectric waveguide filter that is provided with the input/output structure of the dielectric waveguide according to the first embodiment. FIG. 18 is a drawing showing a result of a simulation performed on the magnetic field strength distribution of the dielectric waveguide filter that is provided with the conventional input/output structure of the dielectric waveguide shown in FIG. 17. Both of them show that the weaker the concentration is the stronger the magnetic strength becomes.

From the results of simulations shown in FIG. 2 and FIG. 18, it can be seen that the input/output structure of the dielectric waveguide according to the first embodiment has less leakage of the magnetic field to outside compared with the conventional input/output structure of the dielectric waveguide.

Figure 3:
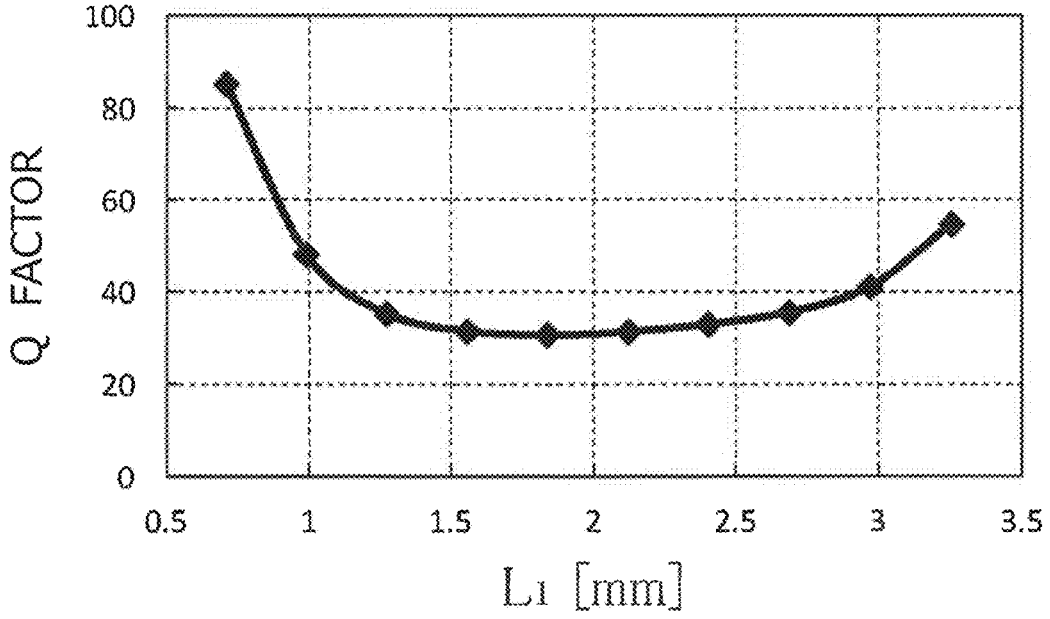
FIG. 3 is a drawing showing a relationship of the external Q factor to the extension length L1 of an input/output electrode of the dielectric waveguide on the dielectric waveguide filter 10 according to the first embodiment.

FIG. 3 is a drawing showing a relationship of the external Q factor to the extension length L1 of an input/output electrode of the dielectric waveguide on the dielectric waveguide filter 10 according to the first embodiment. Here, a diagonal dimension of the bottom face of the dielectric waveguide resonator 20 is approximately 4.2 mm. As evident from FIG. 3, the more the extension length L1 of the input/output electrode is, the less the external Q factor becomes. That is, the coupling coefficient between the input/output electrode and the dielectric waveguide resonator is increased thereby. However, even when the extension length is increased further beyond the center of the bottom face of the dielectric waveguide resonator, it has hardly any effect of improving the coupling coefficient.

Second Preferred Embodiment

In a second embodiment, a dielectric waveguide filter of which input/output electrodes and conductor-unformed sections have different shapes from those in the first embodiment is explained.

Figure 4A:
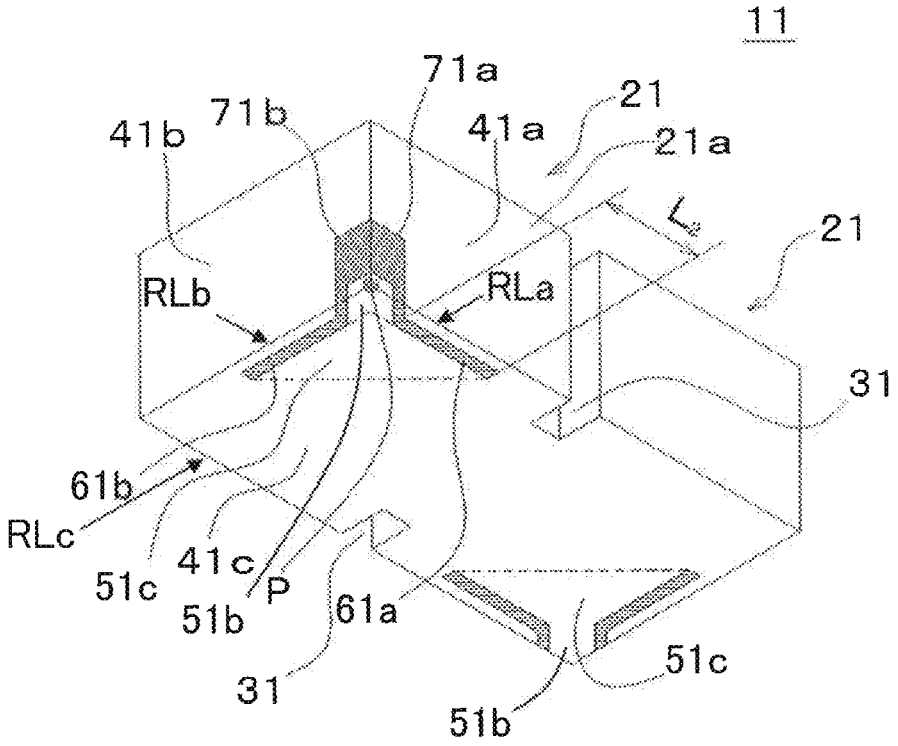
FIG. 4A is a bottom perspective view of a dielectric waveguide filter 11 according to a second embodiment that is provided with an input/output structure of a dielectric waveguide of preferred embodiment of the present invention.
Figure 4B:
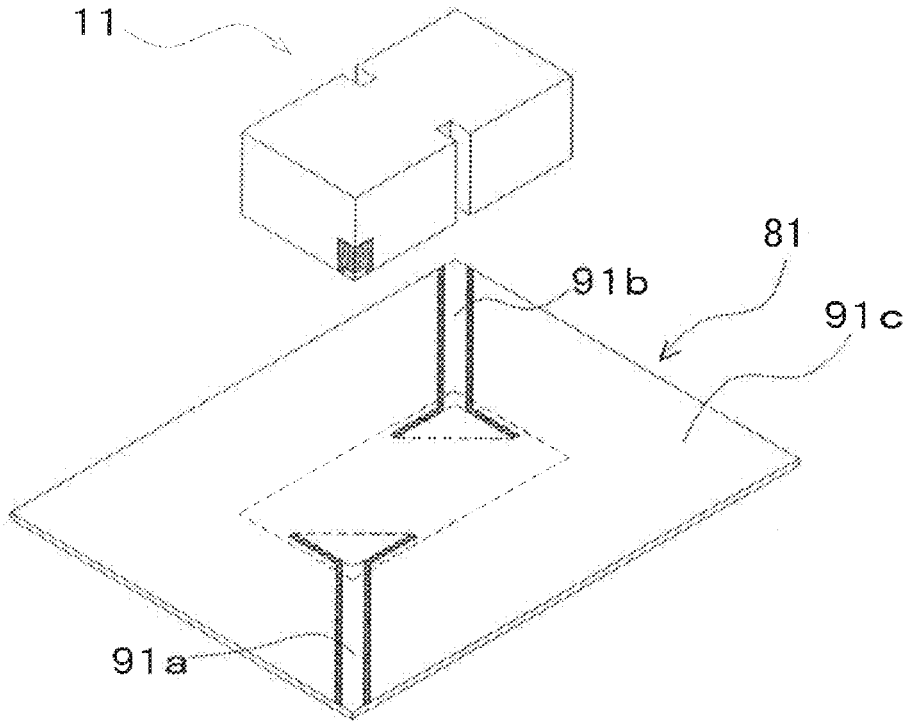
FIG. 4B is an exploded perspective view showing a mounting structure for the dielectric waveguide filter 11 onto a printed circuit board.

FIG. 4A is a bottom perspective view of a dielectric waveguide filter 11 according to a second embodiment that is provided with an input/output structure of a dielectric waveguide of preferred embodiment of the present invention. FIG. 4B is an exploded perspective view showing a mounting structure for the dielectric waveguide filter 11 onto a printed circuit board.

As shown in FIG. 4A, the dielectric waveguide filter 11 includes two dielectric waveguide resonators 21. Each of the dielectric waveguide resonators 21 is a dielectric waveguide resonator that resonates in TE110 mode and is similar to the dielectric waveguide resonator 20 shown in the first embodiment.

The dielectric waveguide resonators 21 include a dielectric of a rectangular parallelepiped in shape in which two domains are formed with a pair of slits 31 provided in between, input/output electrodes 51*b*, 51*c* and a conductor film 21*a* that are formed on an outer face of the dielectric. The slits 31 are an example of a "narrowed section" according to the present invention. It can also be said that the two dielectric waveguide resonators 21 are coupled with each other through a section where the slits 31 are formed.

A bottom face of the dielectric in the dielectric waveguide filter 11 is an H-plane of the waveguide, and the dielectric waveguide resonators 21 are electromagnetically coupled with each other through an iris (inductive window) that is formed by the slits 31.

The input/output electrode 51*b* is a part that extends in a belt-like shape toward a direction to a middle part of the bottom face of the dielectric waveguide resonator. The input/output electrode 51*c* is a triangular part that is formed on the bottom face of the dielectric waveguide resonator. The input/output electrode 51*c* has two sides respectively along two edges RLa, RLb formed by a bottom face 41*c* and remaining two faces (side faces 41*a*, 41*b*) of the three faces (bottom face 41*c* and side faces 41*a*, 41*b*) that intersect at a vertex P.

Environs along both sides and a first end of the input/output electrode 51*b*, 51*c* are provided with conductor-unformed sections 61*a*, 61*b*, 71*a*, 71*b* in which there is no conductor film. The dimension L2 in FIG. 4A is a length of the conductor-unformed sections 61*a*, 61*b* along the edges RLa, RLb. Of the conductor-unformed sections 61*a*, 61*b*, the sections along the edges RLa, RLb are examples of "non-parallel extension section" according to the present invention.

Also in this embodiment, the input/output electrode 51*b* extends from the bottom face 41*c* to the side faces 41*a*, 41*b* of the dielectric waveguide resonator 21.

As shown in FIG. 4B, the dielectric waveguide filter 11 is mounted onto a printed circuit board 81. The printed circuit board 81 includes lines 91*a*, 91*b* of which tip portions are formed in shapes generally the same as the input/output electrodes 51*b*, 51*c*, respectively, and a ground pattern 91*c*. In the state in which the dielectric waveguide filter 11 is mounted, the input/output electrodes (51*b*, 51*c*), (51*b*, 51*c*) of the dielectric waveguide filter 11 are connected to the tips of the lines 91*a*, 91*b* on the printed circuit board 81, respectively, and the conductor film 21*a* of the dielectric waveguide filter 11 is connected to the ground pattern 91*c* on the printed circuit board 81.

The above-mentioned lines 91*a*, 91*b* together with the ground pattern 91*c* constitute a coplanar waveguide. In a case where a planar ground pattern extending on a bottom face of the printed circuit board 81 is formed, they constitute a grounded coplanar waveguide. Further, in the case where the planar ground pattern extending on the bottom face of the printed circuit board 81 is formed, and when widths of electrode-unformed regions on both side portions of the lines 91*a*, 91*b* are wide, the above-mentioned lines 91*a*, 91*b* together with the ground pattern on the bottom face constitute a microstripline.

As mentioned above, in TE mode waveguide resonators, when a resonator is cylindrical in shape, the electric field is strongest at the center of the resonator and weakest at an outer periphery thereof while the magnetic field is distributed uniformly in such a manner as to circumvent the center of the resonator. For this reason, of the current flowing on the conductor film of the dielectric waveguide resonator, current density is high at each middle of the four sides of the bottom face. Therefore, it follows that the longer the dimension L2 of the conductor-unformed sections 61*a*, 61*b* along the above-mentioned edges RLa, RLb the more the current at portions where current densities are high is interrupted. As a result, when L2 is in the neighborhood of ½ of the resonator's length, the coupling coefficient between the input/output electrodes (51*b*, 51*c*) and the dielectric waveguide resonator becomes strongest.

Figure 5:
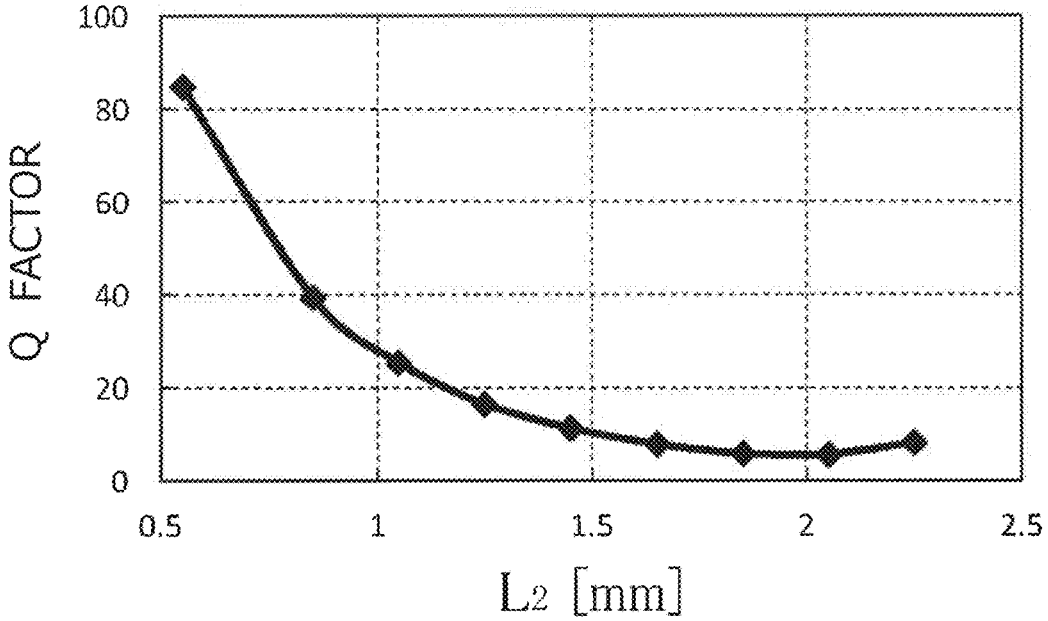
FIG. 5 is a drawing showing a relationship of the external Q factor to the length dimension L2 of conductor-unformed sections 61*a*, 61*b* along edges RLa, RLb in the input/output structure of the dielectric waveguide on the dielectric waveguide filter 11 according to the second embodiment.

FIG. 5 is a drawing showing a relationship of the external Q factor to the length dimension L2 of conductor-unformed sections 61*a*, 61*b* along edges RLa, RLb in the input/output structure of the dielectric waveguide on the dielectric waveguide filter 11 according to the second embodiment. Here, a dimension of the shortest side among the four sides of the bottom face of the dielectric waveguide resonator 21 is approximately 2.5 mm. As evident from FIG. 5, the larger the length dimension L2 of the conductor-unformed sections 61*a*, 61*b* along the edges RLa, RLb is brought to be, the smaller the external Q factor becomes. That is, the coupling coefficient between the input/output electrode and the dielectric waveguide resonator is increased thereby. Compared with the external Q factors on the dielectric waveguide filter shown in the first embodiment, lower external Q factors are obtained on the dielectric waveguide resonator according to the second embodiment.

In this manner, by lowering the external Q factor on the dielectric waveguide resonator, a broader band frequency characteristics can be attained.

Further, in the dielectric waveguide resonator 21 shown in FIG. 4A, the conductor-unformed sections 61*a*, 61*b* may be made asymmetrical, by causing the length of the portion along the edge RLb of the conductor-unformed sections 61*b* to be longer than the length of the portion along the edge RLa of the conductor-unformed sections 61*a*. Also, the conductor-unformed section 61*b* may be extended further along the edge RLc. These procedures can cause the external Q factor to be even smaller.

Third Preferred Embodiment

In a third embodiment, examples of two dielectric waveguide filters each including three or more dielectric waveguide resonators are shown.

Figure 6A:
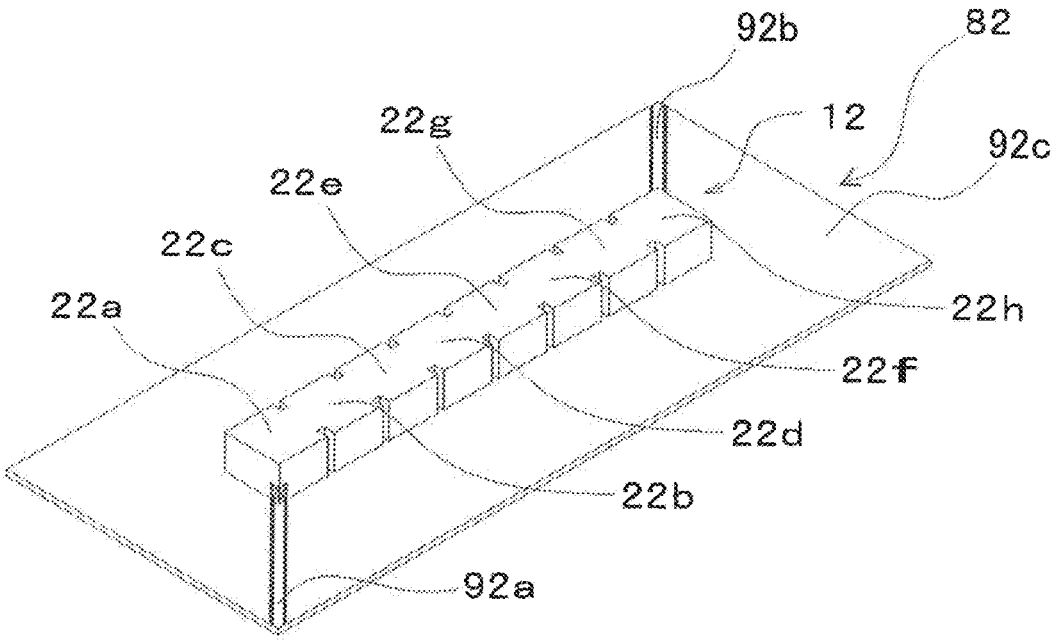
FIG. 6A is a perspective view showing a dielectric waveguide filter 12 according to a third embodiment and a mounting structure therefor.
Figure 6B:
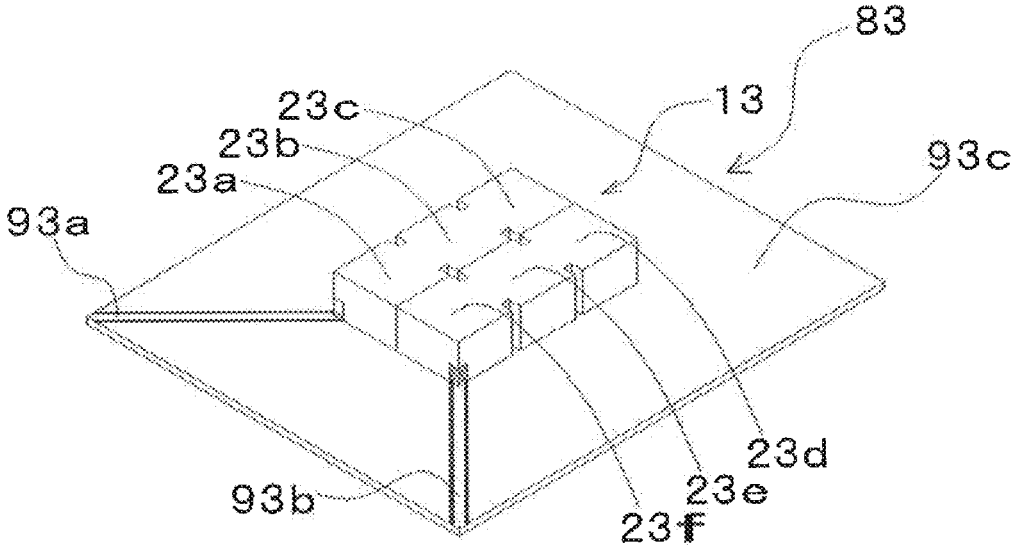
FIG. 6B is a perspective view showing another dielectric waveguide filter 13 according to the third embodiment and a mounting structure therefor.

FIG. 6A is a perspective view showing a dielectric waveguide filter 12 according to a third embodiment and a mounting structure therefor. And FIG. 6B is a perspective view showing another dielectric waveguide filter 13 according to the third embodiment and a mounting structure therefor.

The dielectric waveguide filter 12 shown in FIG. 6A includes eight dielectric waveguide resonators 22*a*, 22*b*, 22*c*, 22*d*, 22*e*, 22*f*, 22*g*, 22*h*. These dielectric waveguide resonators 22*a*-22*h* are disposed in a straight line. On bottom faces of the dielectric waveguide resonators 22*a*, 22*h*, input/output electrodes similar to those shown in FIG. 1A or FIG. 4A are formed.

A printed circuit board 82 includes lines 92*a*, 92*b* of which tip portions are each formed in a shape generally the same as the input/output electrode of the dielectric waveguide filter 12, and a ground pattern 92*c*. In the state in which the dielectric waveguide filter 12 is mounted, the input/output electrodes of the dielectric waveguide filter 12 are connected to the tips of the lines 92*a*, 92*b* on the printed circuit board 82, respectively, and the conductor film of the dielectric waveguide filter 12 is connected to the ground pattern 92*c* on the printed circuit board 82.

The dielectric waveguide resonators 22*a*-22*h* are respectively electromagnetically coupled with adjoining resonators each other. On that account, the dielectric waveguide filter 12 functions as a band-pass filter consisting of resonators connected in 8 stages.

The dielectric waveguide filter 13 shown in FIG. 6B includes six dielectric waveguide resonators 23*a*, 23*b*, 23*c*, 23*d*, 23*e*, 23*f*. These dielectric waveguide resonators 23*a*-23*f* are disposed in U-shape. On bottom faces of the dielectric waveguide resonators 23*a*, 23*f*, input/output electrodes similar to those shown in FIG. 1A or FIG. 4A are formed.

A printed circuit board 83 includes lines 93*a*, 93*b* of which tip portions are each formed in a shape generally the same as the input/output electrode for the dielectric waveguide filter 13, and a ground pattern 93*c*. In the state in which the dielectric waveguide filter 13 is mounted, the input/output electrodes of the dielectric waveguide filter 13 are connected to the tips of the lines 93*a*, 93*b* on the printed circuit board 83, respectively, and the conductor film of the dielectric waveguide filter 13 is connected to the ground pattern 93*c* on the printed circuit board 83.

The dielectric waveguide resonators 23*a*-23*f* couple in the order of 23*a*, 23*b*, 23*c*, 23*d*, 23*e*, 23*f*. Coupling of the dielectric waveguide resonator 23*a* through the dielectric waveguide resonator 23*c*, similarly as in the dielectric waveguide filter 12 shown in FIG. 6A, is attained through irises formed by slits. Coupling of the dielectric waveguide resonator 23*d* through the dielectric waveguide resonator 23*f* is also attained in the same manner.

Coupling of the dielectric waveguide resonator 23*c* with the dielectric waveguide resonator 23*d* is attained using a structure other than the above-mentioned iris. For example, this coupling is attained through a conductor-pattern-unformed section for inter-resonator coupling that is formed on the printed circuit board 83. Or, with conductor-unformed sections respectively provided on opposite faces of the dielectric waveguide resonators 23*c*, 23*d*, coupling is attained through the conductor-unformed sections.

In this manner, lead-out directions of the two input/output electrodes may either be generally parallel as shown in FIG. 6A, or be mutually intersecting directions as shown in FIG. 6B.

Fourth Preferred Embodiment

In a fourth embodiment, an example of a dielectric waveguide filter that is used as a band-pass filter including a trap filter.

Figure 7A:
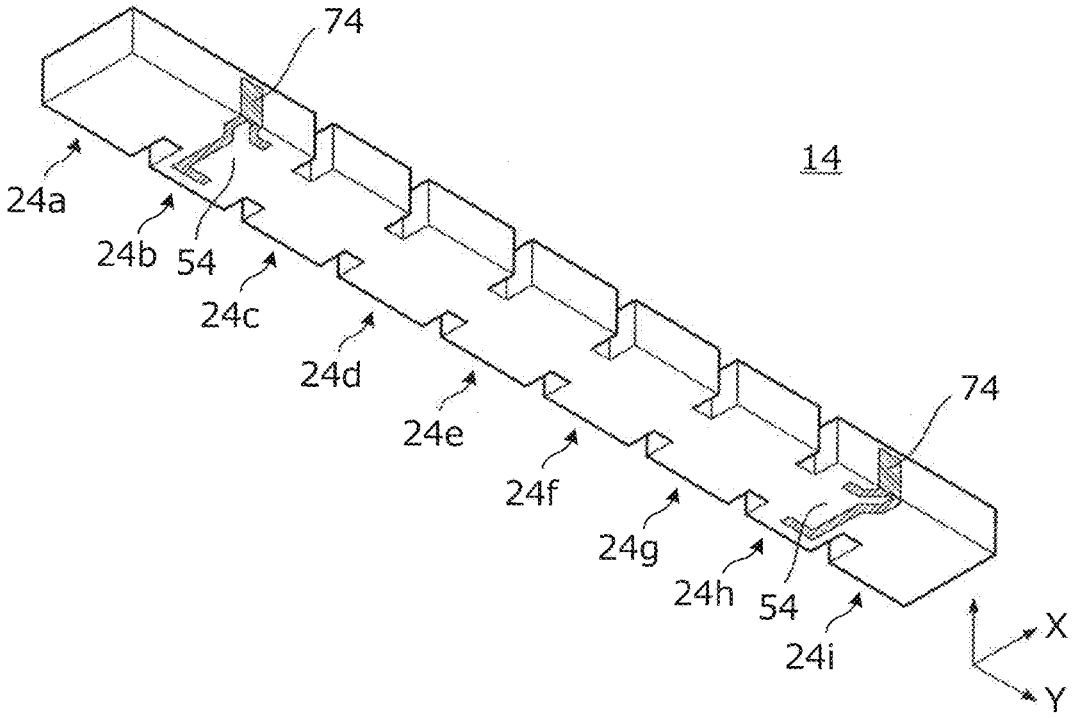
FIG. 7A is a bottom perspective view of a dielectric waveguide filter 14 according to a fourth embodiment.
Figure 7B:
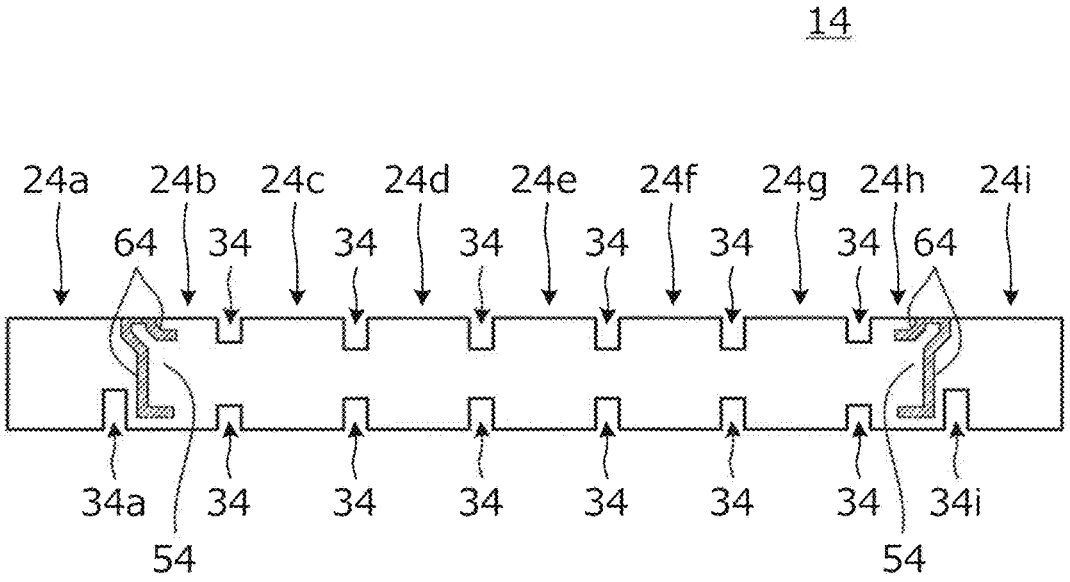
FIG. 7B is a bottom view thereof.

FIG. 7A is a bottom perspective view of a dielectric waveguide filter 14 according to a fourth embodiment. FIG. 7B is a bottom view thereof.

As shown in FIG. 7A, the dielectric waveguide filter 14 includes nine dielectric waveguide resonators 24*a*-24*i*. The dielectric waveguide resonators 24*a*-24*i* are dielectric waveguide resonators that resonate in TE110 mode and are similar to the dielectric waveguide resonators in the embodiments shown so far.

The dielectric waveguide resonators 24*a*-24*i* include a dielectric of a rectangular parallelepiped in shape in which nine domains are formed with a plurality of slits 34 provided, a pair of input/output electrodes 54 and a conductor film that are formed on an outer face of the dielectric. It can also be said that the dielectric waveguide resonators 24*a*-24*i* are coupled together through sections where the slits 34 are formed.

Figure 8:
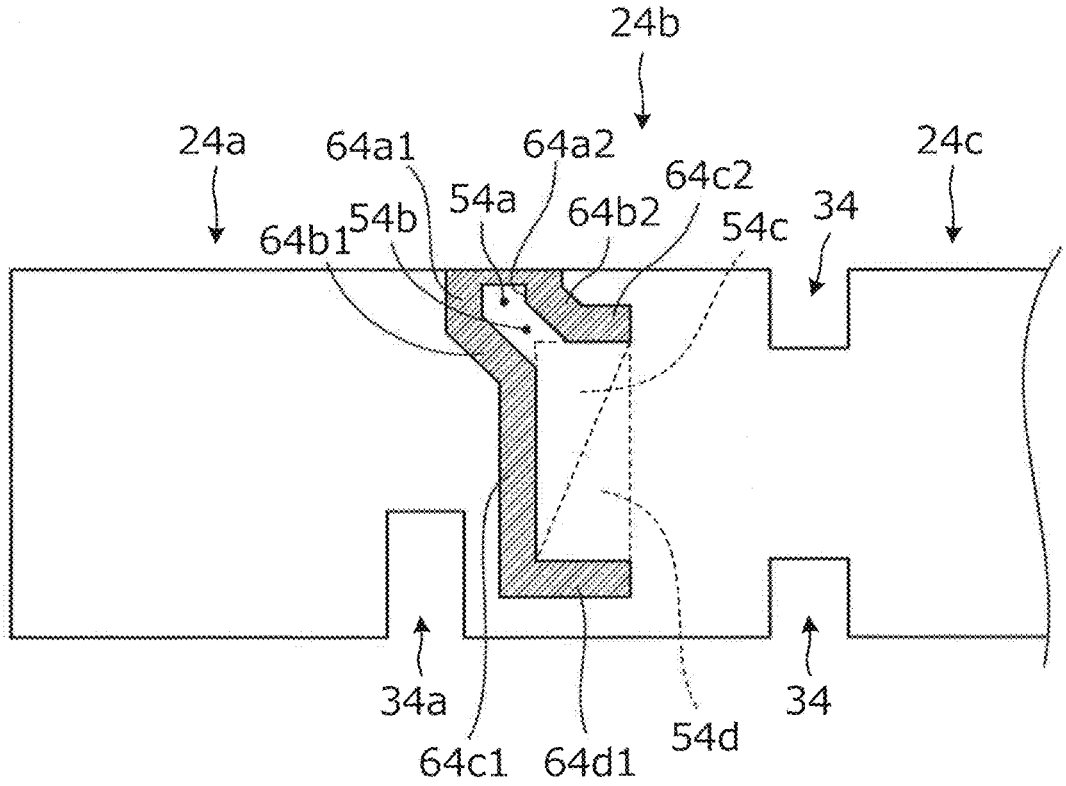
FIG. 8 is a partially enlarged bottom view showing a detailed structure of a section at which an input/output electrode 54 is formed.

FIG. 8 is a partially enlarged bottom view showing a detailed structure of a section at which the above-mentioned input/output electrode 54 is formed. On the bottom face of the dielectric of rectangular parallelepiped in shape, conductor-unformed sections 64*a*1, 64*b*1, 64*c*1, 64*d*1, 64*a*2, 64*b*2, 64*c*2 are provided, respectively. (In FIG. 7B, these conductor-unformed sections are represented by the conductor-unformed section "64" altogether.) The conductor-unformed sections 64*a*1, 64*a*2 extend from one side face of the dielectric toward a direction orthogonal to the side face. The conductor-unformed sections 64*b*1, 64*b*2 extend toward an oblique) (45° direction. Further, the conductor-unformed section 64*c*1 extends in the direction orthogonal to the above-mentioned side face, and the conductor-unformed sections 64*c*2, 64*d*1 respectively extend along the above-mentioned side face. The conductor-unformed sections 64*c*1, 64*c*2, 64*d*1 are examples of "non-parallel extension section" according to the present invention. In this embodiment, the non-parallel extension sections altogether form an asymmetrical shape of which extension lengths of the two conductor-unformed sections are different.

An input/output electrode section 54*a* is a belt-like section sandwiched by the conductor-unformed sections 64*a*1 and 64*a*2, and an input/output electrode section 54*b* is a belt-like section sandwiched by the conductor-unformed sections 64*b*1 and 64*b*2. An input/output electrode section 54*c* is a triangular section sandwiched by the conductor-unformed sections 64*c*1 and 64*c*2. Further, an input/output electrode section 54*d* is a section that remains after the above-mentioned triangular section 54*c* is removed from a quadrangular section sandwiched by the conductor-unformed section 64*d*1 and the conductor-unformed section 64*c*2. (In FIG. 7A, these input/output electrode sections 54*a*, 54*b*, 54*c*, 54*d* are represented by the input/output electrode "54" altogether.)

As in this example, the input/output electrode may be asymmetrical in right-to-left direction with respect to its direction of extension. Also, as in this example, amounts of extension of two conductor-unformed sections may be unbalanced. The larger total amount of extension of the two conductor-unformed sections is brought to be, the smaller the external Q factor can be made.

An input/output structure of the above-mentioned dielectric waveguide resonator 24*h* is similar to that of the dielectric waveguide resonator 24*b*, except that the former together with the latter constitute a symmetrical form in right-to-left direction.

As mentioned above, the input/output electrode 54 extends, inward on the bottom face, from a first end which is a vertex or a neighborhood the vertex of a bottom face of a predetermined domain among a plurality of domains that are formed by narrowed sections in the dielectric. Here, "neighborhood of the vertex of a bottom face of a predetermined domain" is, for example, a range of distance less than a fourth of an extension length of the input/output electrode 54. The above-mentioned "predetermined domain" means a domain of a dielectric waveguide resonator in which input/output is performed. Also, the statement that environs along the first end of the input/output electrode 54 are a conductor-unformed section means that starting point in the direction of extension of the input/output electrode 54 is separated from the conductor film.

Moreover, the input/output electrode 54 is not limited to the one that extends from the neighborhood of the vertex of the above-mentioned predetermined domain. With a definition of the vertex as "a first end" according to the present invention, therefrom the input/output electrode 54 may extend inward on the bottom face.

Of the dielectric waveguide resonators 24*a*-24*i*, the dielectric waveguide resonator 24*a*, 24*i* at either end couples with the input/output section with a phase difference amounting to a fourth of the wavelength in relation to the input/output section. Therefore, the dielectric waveguide resonators 24*a*, 24*i* each function as a trap resonator. The dielectric waveguide resonators 24*b*-24*h* function as a band-pass filter consisting of seven stages of resonators that are cascade-connected.

Size (size of resonance space) of the dielectric waveguide resonator 24*a* is different from that of the dielectric waveguide resonator 24*i*. Size (size of resonance space) of the dielectric waveguide resonator 24*b* is also different from that of the dielectric waveguide resonator 24*h*.

Additionally, between the dielectric waveguide resonator 24*b* and the dielectric waveguide resonator 24*a*, not on both side faces of the dielectric but on one side face, one slit 34*a* is formed. Similarly, between the dielectric waveguide resonator 24*h* and the dielectric waveguide resonator 24*i*, on one side face, one slit 34*i* is formed. Also, these slits 34*a*, 34*i* are larger (in this example, deeper in depth) than the slits 34 provided between the other dielectric waveguide resonators. This makes it possible to arrange the conductor-unformed section 64 and the input/output electrode 54 in the neighborhood of a corner of the resonance space without being influenced by the slit.

The dielectric waveguide resonators 24*a*-24*i* couple thorough irises formed by the slits 34 in the order of the dielectric waveguide resonators 24*b*, 24*c*, 24*d*, 24*e*, 24*f*, 24*g*, 24*h*. Also, the dielectric waveguide resonators 24*a* and 24*b* couple thorough an iris formed by the slit 34*a*. Likewise, the dielectric waveguide resonators 24*h* and 24*i* couple thorough an iris formed by the slit 34*i*.

Figure 9:
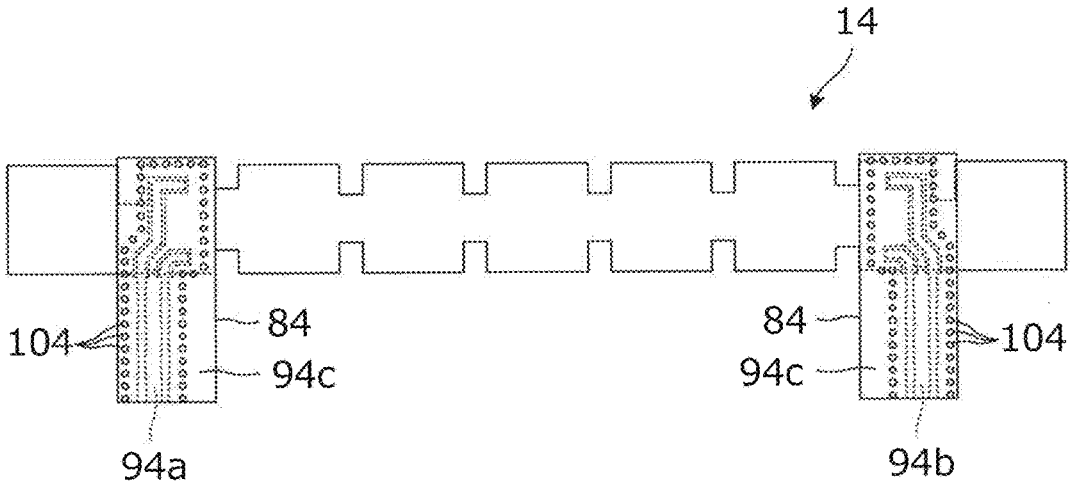
FIG. 9 is a top view showing a connection structure of a printed circuit board for the dielectric waveguide filter 14.

FIG. 9 is a top view showing a connection structure of a printed circuit board for the dielectric waveguide filter 14. A printed circuit board 84 includes lines 94*a*, 94*b* of which tip portions are each formed in a shape generally the same as the above-mentioned input/output electrode 54 (see FIG. 7B), and a ground pattern 94*c*. In either side portion of the line 94*a*, a large number of via holes 104 connecting the ground pattern 94*c* on a top face to a ground pattern on a bottom face are arranged. Also, in either side portion of the line 94*b*, a large number of via holes 104 connecting the ground pattern 94*c* on the top face to the ground pattern on the bottom face are arranged.

The tips of the lines 94*a*, 94*b* on the printed circuit board 84 are respectively connected to the input/output electrodes 54 of the dielectric waveguide filter 14, and the ground pattern 94*c* on the printed circuit board 84 is connected to the conductor film of the dielectric waveguide filter.

The above-mentioned lines 94*a*, 94*b* together with the ground patterns on the top and bottom faces constitute a grounded coplanar waveguide.

Figure 10:
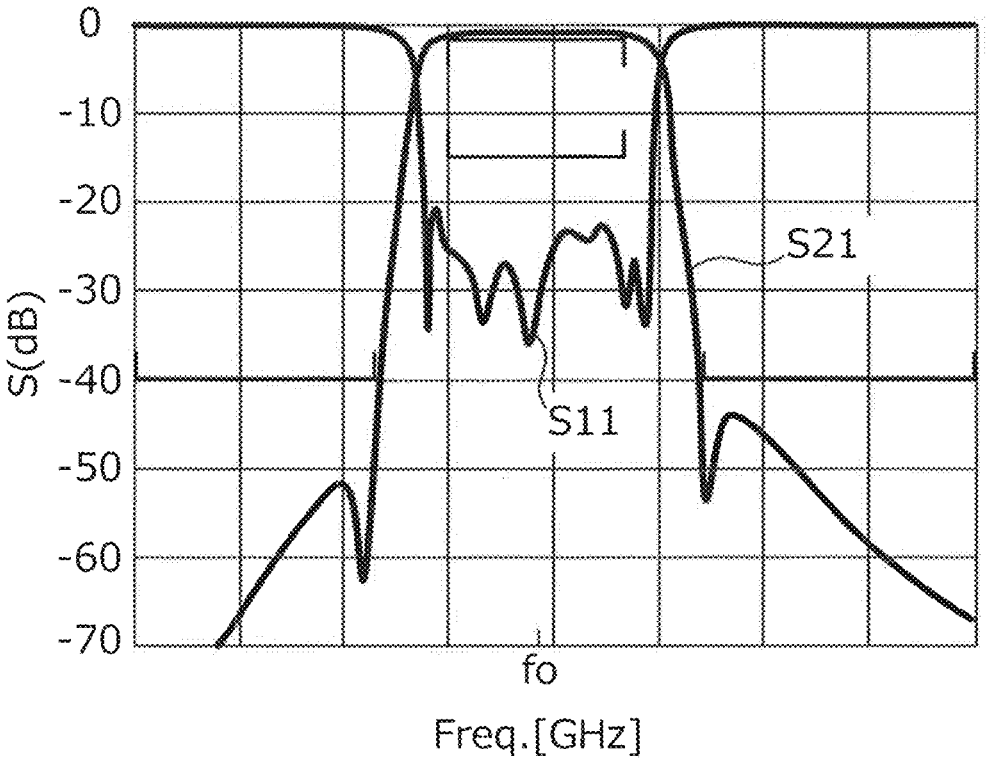
FIG. 10 is a drawing showing frequency characteristics on an insertion loss and a return loss of the dielectric waveguide filter 14 according to the fourth embodiment.

FIG. 10 is a drawing showing frequency characteristics on an insertion loss and a return loss of the dielectric waveguide filter 14 according to this embodiment. Requirements for the characteristics of the dielectric waveguide filter are as follows:

[Passband]

Passband width: center frequency fo ±0.425 GHz or more

Insertion loss within the passband: less than −1.5 dB

Return loss within the passband: less than −15 dB

[Cutoff Band]

−40 dB attenuation bandwidth: center frequency fo −0.775 GHz or more, +0.775 GHz or less Insertion loss within the attenuation band: less than −40 dB where, the above-mentioned center frequency fo is several ten GHz, for example.

The dielectric waveguide filter 14, as shown in FIG. 10, fulfills the above-mentioned requirements.

Fifth Preferred Embodiment

In a fifth embodiment, a dielectric waveguide filter and a mounting structure therefor are shown, where the dielectric waveguide filter includes a trap filter, and the dielectric waveguide resonators arranged in two rows.

Figure 11:
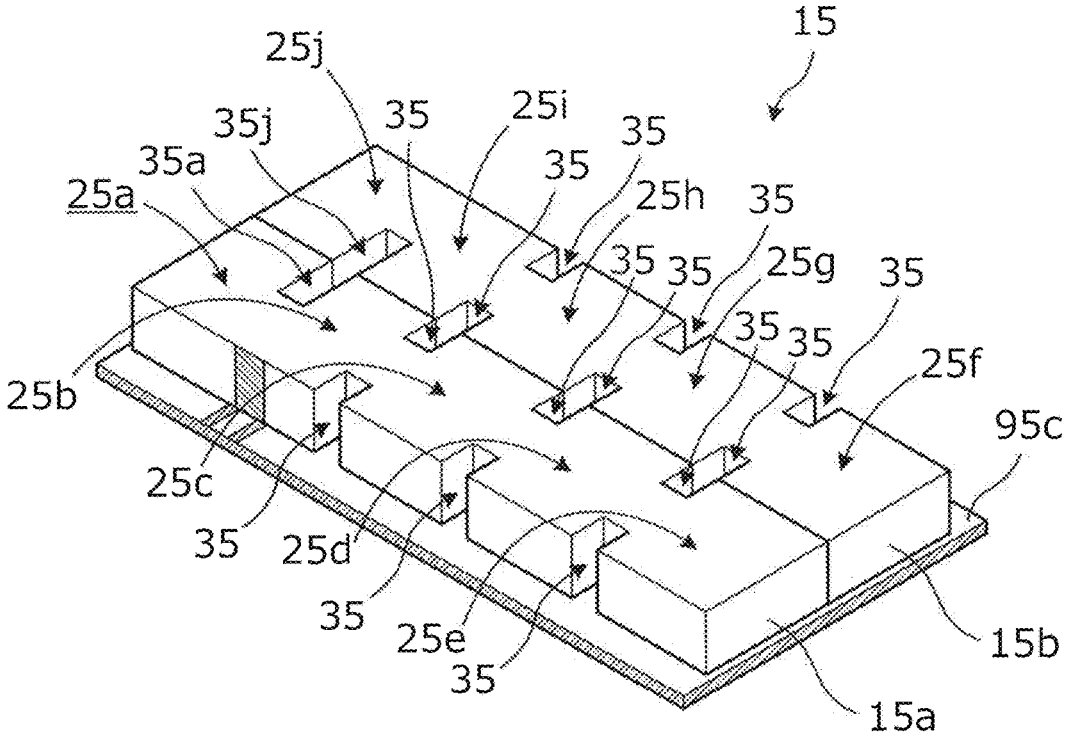
FIG. 11 is a perspective view showing dielectric waveguide filters 15*a*, 15*b* according to a fifth embodiment and a mounting structure therefor.
Figure 12:
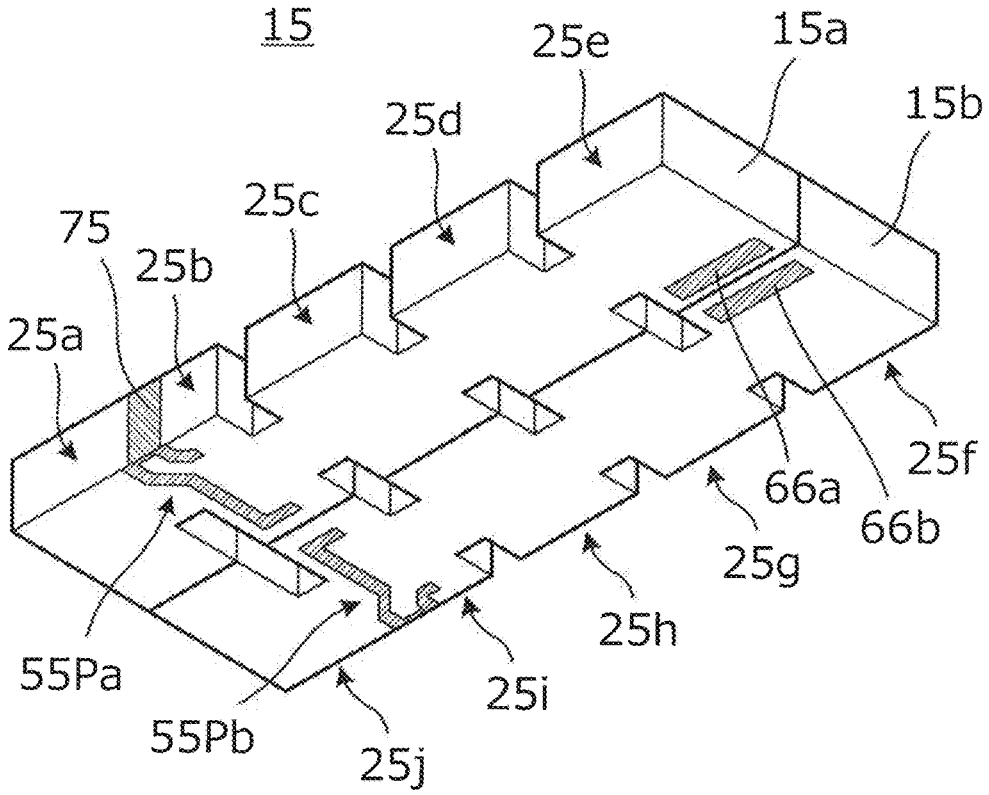
FIG. 12 is a bottom perspective view of the dielectric waveguide filters 15*a*, 15*b*, and a perspective view of a printed circuit board.
Figure 12:
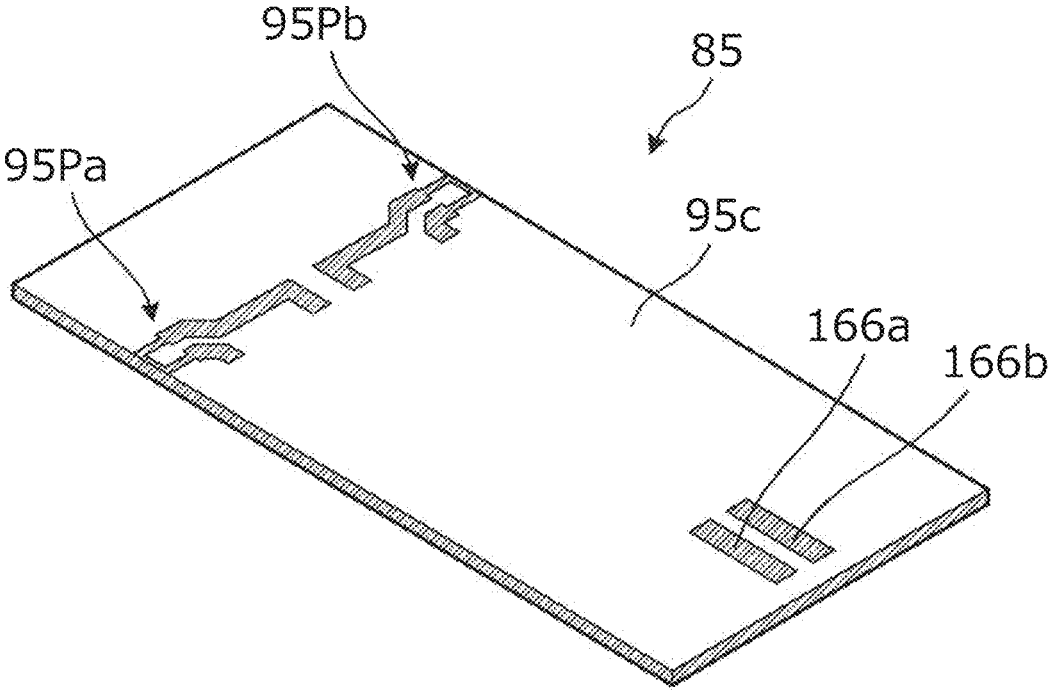

FIG. 11 is a perspective view showing dielectric waveguide filters 15*a*, 15*b* according to a fifth embodiment and a mounting structure therefor. FIG. 12 is a bottom perspective view of the dielectric waveguide filters 15*a*, 15*b*, and a perspective view of a printed circuit board.

The dielectric waveguide filter 15*a* shown in FIG. 11 includes five dielectric waveguide resonators 25*a*, 25*b*, 25*c*, 25*d*, 25*e*. Also, the dielectric waveguide filter 15*b* includes five dielectric waveguide resonators 25*f*, 25*g*, 25*h*, 25*i*, 25*j*. These dielectric waveguide resonators 25*a*-25*j* are disposed in U-shape.

On bottom faces of the dielectric waveguide resonators 25*b*, 25*i*, formed are input/output structure sections 55Pa, 55Pb that are each similar to the input/output structure section formed by the input/output electrode and the conductor-unformed section shown in FIG. 8. Also, on bottom faces of the dielectric waveguide resonators 25*e*, 25*f*, conductor-unformed sections 66*a*, 66*b* are provided.

On a printed circuit board 85, provided are board-side input/output structure sections 95Pa, 95Pb that are to be faced by the above-mentioned input/output structure sections 55Pa, 55Pb. Also, provided are board-side conductor-unformed sections 166*a*, 166*b* that are to be faced by the above-mentioned conductor-unformed sections 66*a*, 66*b*.

In the state in which the dielectric waveguide filters 15*a*, 15*b* are mounted, the board-side input/output structure sections 95Pa, 95Pb on the printed circuit board 85 are faced by the input/output structure sections 55Pa, 55Pb of the dielectric waveguide resonators, and the board-side conductor-unformed sections 166*a*, 166*b* are faced by the conductor-unformed sections 66*a*, 66*b* of the dielectric waveguide resonators.

The dielectric waveguide resonators 25*b*-25*i* couple thorough irises formed by slits 35 in the order of the dielectric waveguide resonators 25*b*, 25*c*, 25*d*, 25*e*, 25*f*, 25*g*, 25*h*, 25*i*. Also, the dielectric waveguide resonators 25*a* and 25*b* couple thorough an iris formed by a slit 35*a*. Likewise, the dielectric waveguide resonators 25*i* and 25*j* couple thorough an iris formed by a slit 35*j*.

The dielectric waveguide resonators 25*e* and 25*f* couple through the board-side conductor-unformed sections 166*a*, 166*b* and the conductor-unformed sections 66*a*, 66*b* of the dielectric waveguide resonators.

Sixth Preferred Embodiment

In a sixth embodiment, shown is an example of a dielectric waveguide filter that is formed by coupling two dielectric waveguide resonators in different rows from each other without going through a board.

Figure 13:
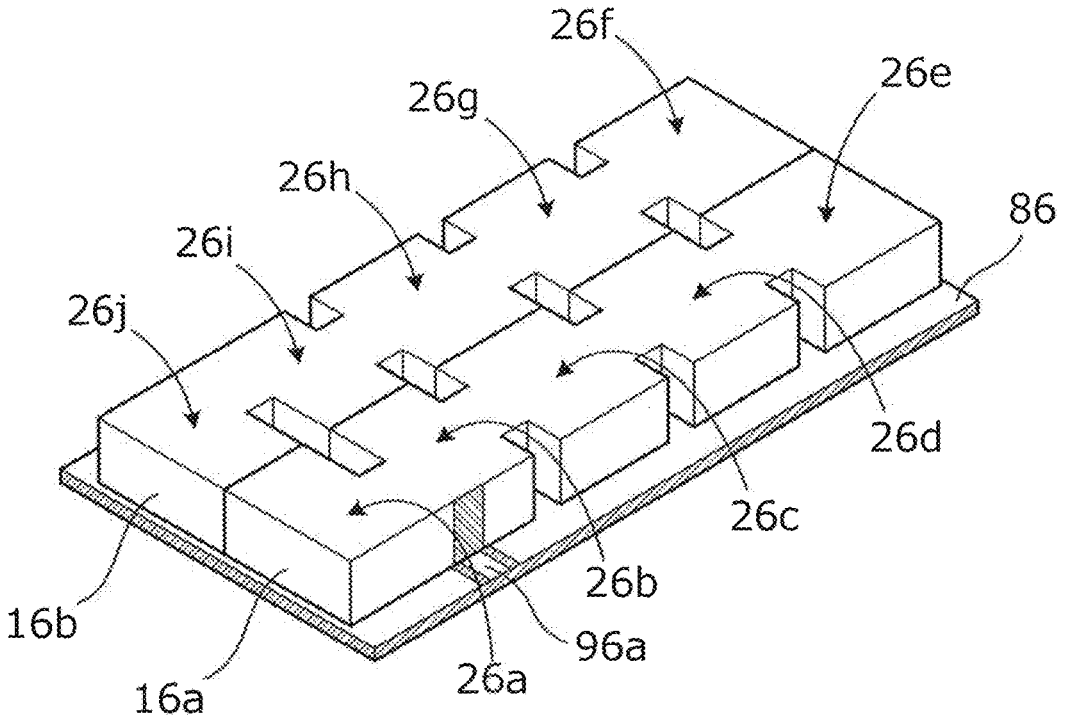
FIG. 13 is a perspective view showing dielectric waveguide filters 16*a*, 16*b* according to a sixth embodiment and a mounting structure therefor.
Figure 14:
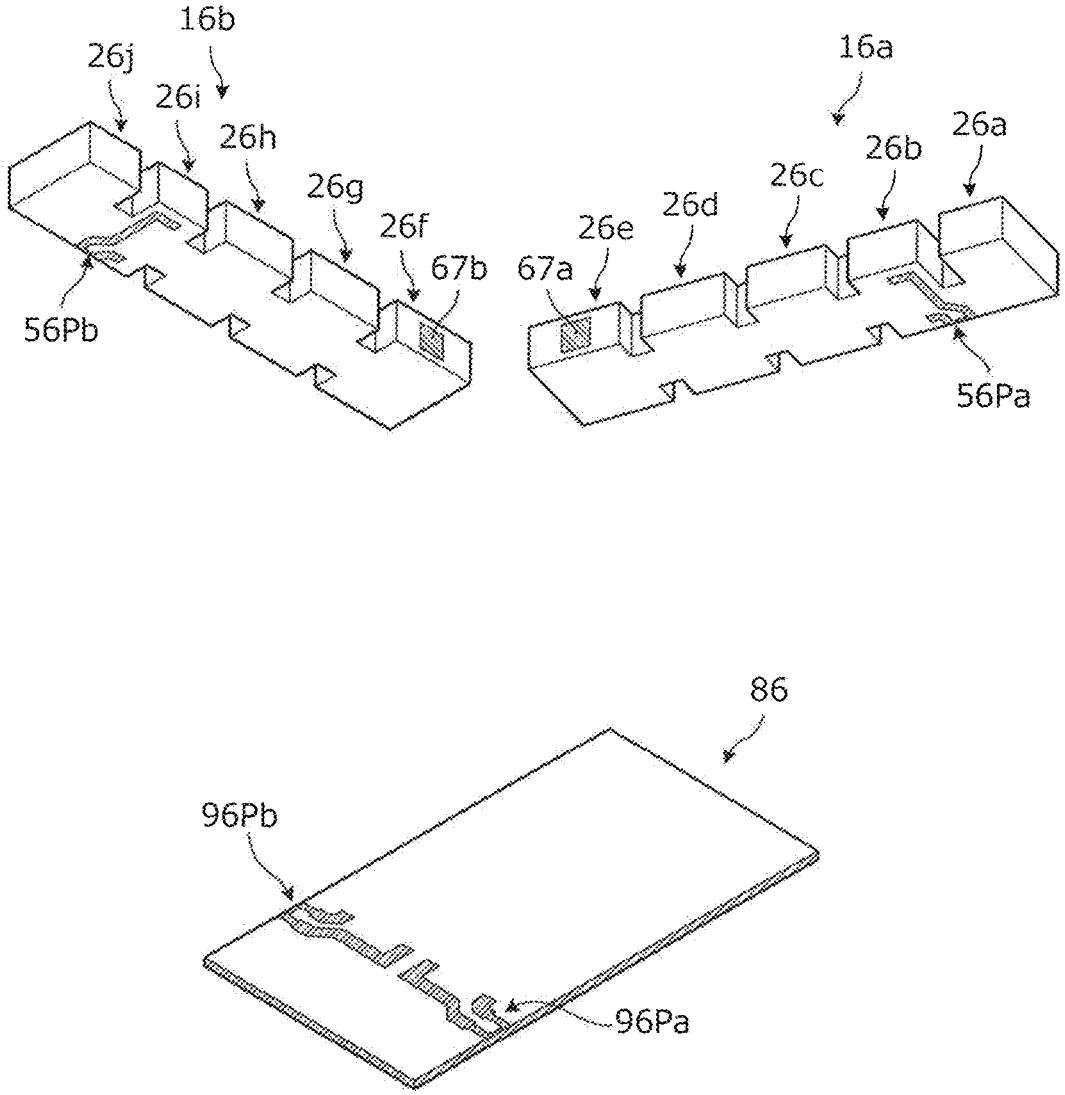
FIG. 14 is a bottom perspective view of the dielectric waveguide filters 16*a*, 16*b*, and a perspective view of a printed circuit board.

FIG. 13 is a perspective view showing dielectric waveguide filters 16*a*, 16*b* according to a sixth embodiment and a mounting structure therefor. FIG. 14 is a bottom perspective view of the dielectric waveguide filters 16*a*, 16*b*, and a perspective view of a printed circuit board 86.

The dielectric waveguide filter 16*a* shown in FIG. 13 includes five dielectric waveguide resonators 26*a*, 26*b*, 26*c*, 26*d*, 26*e*. Also, the dielectric waveguide filter 16*b* includes five dielectric waveguide resonators 26*f*, 26*g*, 26*h*, 26*i*, 26*j*. These dielectric waveguide resonators 26*a*-26*j* are disposed in U-shape.

On bottom faces of the dielectric waveguide resonators 26*b*, 26*i*, formed are input/output structure sections 56Pa, 56Pb that are each similar to the input/output structure section formed by the input/output electrode and the conductor-unformed section shown in FIG. 8. Also, on side faces of the dielectric waveguide resonators 26*e*, 26*f*, conductor-unformed sections 67*a*, 67*b* are formed, respectively.

On a printed circuit board 86, provided are board-side input/output structure sections 96Pa, 96Pb that are to be faced by the above-mentioned input/output structure sections 56Pa, 56Pb.

In the state in which the dielectric waveguide filters 16*a*, 16*b* are mounted onto the printed circuit board 86, to the board-side input/output structure sections 96Pa, 96Pb on the printed circuit board 86, the input/output structure sections 56Pa, 56Pb of the dielectric waveguide resonators are connected. Further, with the conductor-unformed sections 67*a*, 67*b* facing each other, the dielectric waveguide resonators 26*e*, 26*f* couple with each other.

Seventh Preferred Embodiment

In a seventh embodiment, an example of a Massive MIMO system including a dielectric waveguide filter is shown.

Among promising wireless communication technologies in 5G (Fifth Generation Mobile Communication System) is a combination of the phantom cell and a Massive MIMO system. The phantom cell is a network configuration between macrocells in lower frequency bands and small cells in high frequency bands that allows for separating control signals for securing the stability of communication from data signals as the object of high speed data communication. Each phantom cell is provided with an antenna device of a Massive MIMO system. The Massive MIMO system is a technology for improving the transmission quality in millimeter wave bands, etc., and performs coordination of signals transmitted from each antenna device to control directivity. Also, by using a large number of antenna devices, a sharply directional beam is formed. By enhancing the directivity of the beams, it is made possible to transmit radio waves to certain long distances even in high frequency bands, and it is also made possible to reduce inter-cellular interferences to increase the efficiency of frequency utilizations.

Figure 15:
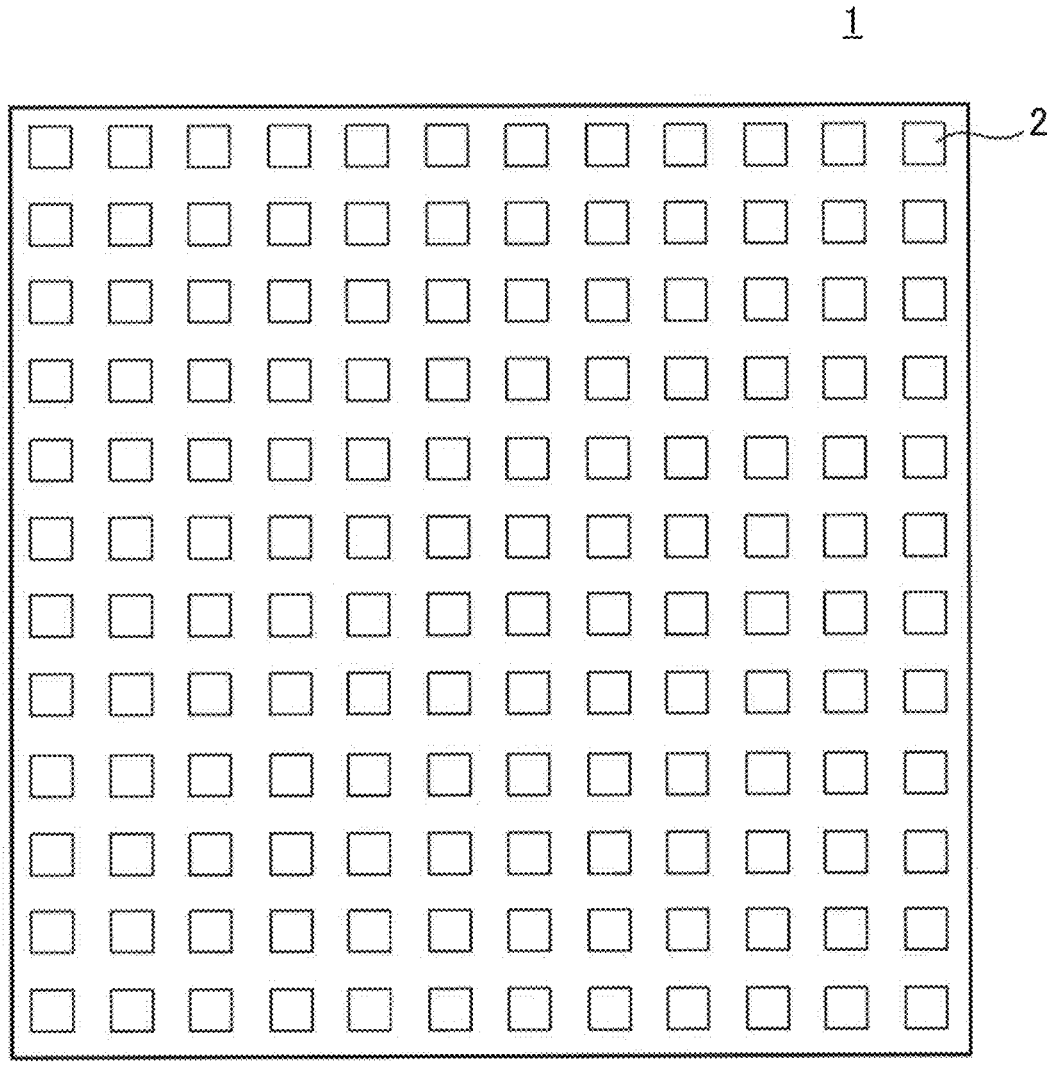
FIG. 15 is a top view of an antenna device 1 used in a Massive MIMO system.

FIG. 15 is a top view of an antenna device 1 used in the above-mentioned Massive MIMO system. The antenna device 1 includes a plurality of patch antennas 2 arranged in rows and columns.

Figure 16:
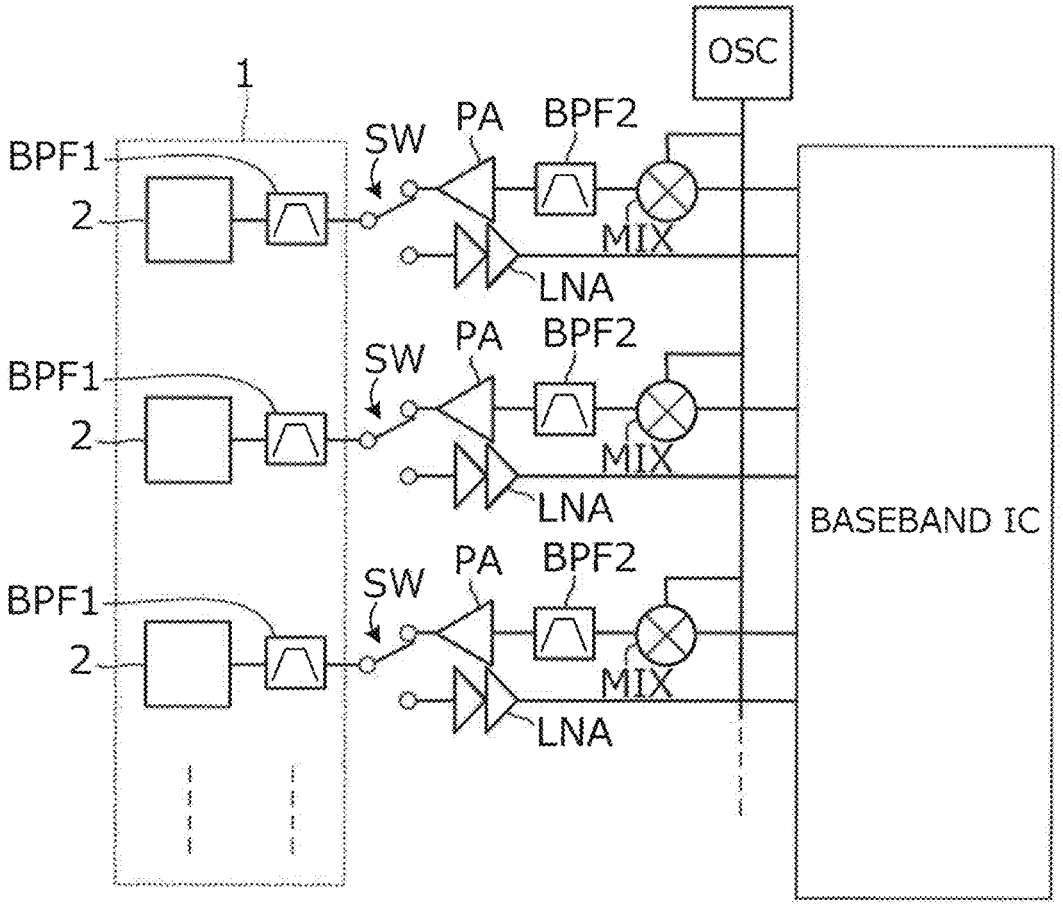
FIG. 16 is a drawing showing a configuration of the antenna device 1 and a configuration of a front-end circuit connected to the antenna device 1.

FIG. 16 is a drawing showing a configuration of the antenna device 1 and that of a front-end circuit connected to the antenna device 1. To the patch antenna 2, a band-pass filter BPF1 is connected. Between the band-pass filter BPF1 and a power amplifier PA or a low noise amplifier LNA, a switch SW is connected. The low noise amplifier LNA is connected to a reception signal input section of a baseband IC. Between a transmission signal output section of the baseband IC and the power amplifier PA, a mixer MIX and a band-pass filter BPF2 are connected. To the mixer MIX, a local oscillator OSC is connected.

The above-mentioned band-pass filter BPF1 allows components within transmission-reception frequency bands to pass while removing the other frequency components. The switch SW switches between the transmission signal and the reception signal. The band-pass filter BPF2 allows components within a frequency band for the transmission signal to pass while removing the other frequency components.

For the above-mentioned band-pass filters BPF1, BPF2, the dielectric waveguide filters shown in the embodiments 1 through 6 can be used.

The dielectric waveguide filters according to the present invention can be composed in such small sizes that the band-pass filter BPF1 connected to the patch antenna 2 may be disposed, for example, on the other side of the board on one side of which the patch antenna 2 is formed. By following this procedure, the antenna device 1 including the patch antenna 2 that is provided with the band-pass filter BPF1 can be composed.

Finally, the above explanations of the embodiments are neither anything more than illustrative in any respect, nor anything restrictive. It is possible for a person skilled in the art to make modifications or alterations thereto accordingly. Scope of the present invention is indicated by claims rather than the above embodiments. Further, the scope of the present invention includes any alterations to the embodiments that are within the scope of equivalence to the claims.

What is claimed is:

1. A dielectric waveguide comprising:

a dielectric waveguide resonator that is a rectangular parallelepiped in shape, includes an H-plane, and resonates in TE mode;

an input/output electrode that is disposed on the H-plane and includes at least a portion extending from a corner portion of the H-plane in a direction to a middle of the H-plane;

a conductor film that covers at least a portion of the dielectric waveguide resonator; and a conductor-unformed section that includes no conductor film and is disposed on an outer side of one end of the input/output electrode that is adjacent to the corner portion and on an outer side of both sides of the input/output electrode that are continuous with the one end adjacent to the corner portion.

2. The dielectric waveguide according to claim 1, wherein the input/output electrode includes a belt-like section.

3. A dielectric waveguide filter comprising the dielectric waveguide according to claim 1.

4. A Massive MIMO system comprising:

the dielectric waveguide filter according to claim 3; and an antenna including a plurality of patch antennas arranged in rows and columns.

5. The dielectric waveguide according to claim 1, wherein the conductor-unformed section comprises non-parallel extension sections respectively extending along two edges that are formed by the H-plane and remaining two faces among three faces that intersect at a vertex nearest to the corner portion of the H-plane.

6. The dielectric waveguide according to claim 5, wherein the non-parallel extension sections have extension lengths different from each other.

7. A mounting structure for a dielectric waveguide, comprising:

a printed circuit board including a line; and the dielectric waveguide according to claim 1 that is mounted on the printed circuit board.

8. The mounting structure for a dielectric waveguide according to claim 7, wherein the line comprises a microstripline structure or coplanar waveguide structure with a ground conductor on a surface of the printed circuit board;

the one end of the input/output electrode is connected to the line provided on the printed circuit board; and the conductor film of the dielectric waveguide is connected to the ground conductor on the printed circuit board.

9. The mounting structure for a dielectric waveguide according to claim 7, wherein the line includes a tip portion; and a width of the input/output electrode is larger than a width of the tip portion of the line.

10. The mounting structure for a dielectric waveguide according to claim 9, wherein the line comprises a microstripline structure or coplanar waveguide structure with a ground conductor on a surface of the printed circuit board;

the one end of the input/output electrode is connected to the line provided on the printed circuit board; and the conductor film of the dielectric waveguide is connected to the ground conductor on the printed circuit board.

11. The dielectric waveguide according to claim 1, further comprising a plurality of dielectric waveguide resonators, wherein:

the plurality of dielectric waveguide resonators include a plurality of domains that are formed by one or more narrowed sections; and the input/output electrode is disposed in a predetermined domain among the plurality of domains.

12. The dielectric waveguide according to claim 11, wherein the input/output electrode includes a belt-like section.

13. A dielectric waveguide filter comprising the dielectric waveguide according to claim 11, wherein the plurality of domains are respectively resonance domains of the dielectric waveguide resonators;

the plurality of resonance domains couple through the one or more narrowed sections and a domain that adjoins a resonance domain in which the input/output electrode is formed among the plurality of resonance domains and is located at an end portion of the dielectric waveguide is a trap resonator.

14. The dielectric waveguide filter according to claim 13, wherein the plurality of dielectric waveguide resonators are arranged in two rows; and domains that are respectively farthest from the domains in which the input/output electrodes are formed among the plurality of domains couple with each other through conductor-unformed sections.

15. A dielectric waveguide filter comprising the dielectric waveguide according to claim 11.

16. A Massive MIMO system comprising:

the dielectric waveguide filter according to claim 15; and an antenna including a plurality of patch antennas arranged in rows and columns.

17. The dielectric waveguide according to claim 11, wherein the conductor-unformed section comprises non-parallel extension sections that include a section extending toward a direction in which the plurality of domains are arranged, and a section extending toward a direction orthogonal to the direction of the arrangement.

18. The dielectric waveguide according to claim 17, wherein the non-parallel extension sections have extension lengths different from each other.

* * * * *